US007344441B2

(12) United States Patent
Diostilio

(10) Patent No.: US 7,344,441 B2
(45) Date of Patent: Mar. 18, 2008

(54) CARD GAME METHOD AND APPARATUS

(76) Inventor: Thomas R. Diostilio, 414 Morton Ave., Folsom, PA (US) 19033

( * ) Notice: Subject to any disclaimer, the term of this patent is extended or adjusted under 35 U.S.C. 154(b) by 796 days.

(21) Appl. No.: 10/373,348

(22) Filed: Feb. 24, 2003

(65) Prior Publication Data

US 2004/0166916 A1 Aug. 26, 2004

(51) Int. Cl.
*A63F 1/00* (2006.01)
*A63F 13/00* (2006.01)

(52) U.S. Cl. ..... 463/16; 463/13; 273/292; 273/274

(58) Field of Classification Search ..... 273/292, 273/274, 309; 463/13, 12, 6
See application file for complete search history.

(56) References Cited

U.S. PATENT DOCUMENTS 3,998,462 A 12/1976 Goott ..... 273/130
4,651,997 A 3/1987 Wood ..... 273/274
4,659,087 A 4/1987 Shen et al. ..... 273/274
4,836,553 A 6/1989 Shuttle et al. ..... 273/292
5,022,653 A 6/1991 Shuttle et al. ..... 273/85
5,072,946 A 12/1991 Miller ..... 273/292
5,813,673 A 9/1998 Richardson ..... 273/292
6,406,024 B1 6/2002 Perkins ..... 273/292
6,547,246 B2 * 4/2003 Webb ..... 273/292
6,695,312 B1 * 2/2004 Ward ..... 273/292
7,118,111 B1 * 10/2006 Altomare ..... 273/292

OTHER PUBLICATIONS

"Yablon", Scarne's Encyclopedia of Games, Harper & Row Publishers, p. 313, 1973.*

* cited by examiner

*Primary Examiner*—Benjamin Layno
(74) *Attorney, Agent, or Firm*—Robert S. Lipton, Esq.; Lipton, Weinberger & Husick

(57) ABSTRACT

A method and apparatus for playing a card game is provided. A player receives three playing cards. The player arranges the cards in sequence and predicts where in the sequence a fourth card will fall. The player receives a fourth card. If the player's prediction is correct, the player wins. The player may wager on the success of the prediction and may wager on poker hands defined by the four cards received by the player.

7 Claims, 7 Drawing Sheets

CARD GAME METHOD AND APPARATUS

FIELD OF THE INVENTION

The present Invention relates to a method of playing a game utilizing one or more decks of playing cards and having particular application to the gaming industry. The present Invention also relates to an apparatus for playing the game. The game may be played using a computer, including a computer attached to a computer network.

BACKGROUND OF THE INVENTION

Card games using the familiar fifty-two card deck have been known for centuries. Card games are popular and commercially valuable in the gaming industry. In the gaming industry, the odds of success by a player are adjusted so that the gaming establishment, on average, retains a predictable proportion of each dollar bet. Providing a player with the multiple opportunities to bet increases the total return to the gaming establishment. Providing a high speed of play so that the player may place more bets in a shorter time also increases the total return of the gaming establishment. Providing the player with an element of control over the play of the game allows the player to develop skill and provides interest to the player.

The game of "In Between," also known as "Acey-Deucy," is a casino card game. In the game of In Between, a player makes an ante and is dealt two cards by a dealer. The player can choose to place a wager based on the value of the cards or to fold. If the player folds, the player forfeits his or her ante. If the player bets, then the player is dealt a third card. If the face value of the third card falls between the face values of the first and second cards, then the player wins and receives a gaming prize. If the face value of the third card dealt to the player does not fall between the face values of the first and second cards, then the player loses and forfeits his or her wager.

SUMMARY OF THE INVENTION

The present Invention provides a game in which a player places three randomly selected playing cards on three of four provided spaces such that a fourth randomly selected card placed on the fourth space will cause all four cards to appear in a sequence from lowest face value to highest face value. The player has two opportunities to wager during the game of the present Invention. The player must place a first wager on the success of arranging his or her cards so that the value of the fourth card appears in sequence. If the player wins the first wager then the player wins a first gaming prize. The player may place a second wager independently of the first wager and may win or lose the second wager based on predetermined criteria, such as whether the combinations of four cards received by the player forms a poker hand on a schedule of poker hands. If the player wins the second wager then the player wins a second gaming prize.

To play the game, the player places a first wager and may place a second wager. The player is dealt three cards from one or more fifty-two card decks by a dealer. The player looks at the three cards and arranges the three cards in sequence by face value with the deuce being the lowest and the ace being the highest. The player then predicts where a future fourth card will fall within the sequence of three cards. The player places the three cards on three of four spaces provided to the player, leaving any one of the four spaces empty. By so doing, the player predicts where in the sequence of cards the face value of the fourth card will fall. The dealer then deals the fourth card to the player and the fourth card is placed on the remaining space. If the face value of the fourth card falls in sequence, the player wins the first wager. If the face value of the fourth card does not fall within the sequence, the player loses. If the player wins, the player collects a first gaming prize. If the player loses, the player forfeits his or her first wager.

If at the start of game play the player elected to place a second wager and if the four cards dealt to the player form a poker hand matching any of several poker hands in a schedule of poker hands, the player wins the second wager and collects a second gaming prize. The player may place the second wager independently from the first wager and may win the second gaming prize independently from the first gaming prize.

The amount of the second gaming prize may depend upon the amount of the second wager placed by the player, upon the poker hand dealt to the player compared to the schedule of poker hands, and upon a payout schedule determined by the gaming establishment. The payout schedule is selected by the gaming establishment to provide the player with an adequate incentive to play while providing the gaming establishment with an adequate return.

The game may be played using a human dealer to deal cards to the player. Alternatively, the game may be played using a computer or other display mechanism to display information to the player. The player may make game play decisions and predictions using the computer or other display mechanism. The computer may be a stand alone computer or a client computer connected to a server computer over a network, such as the Internet.

DESCRIPTION OF AN EMBODIMENT

Figure 1:
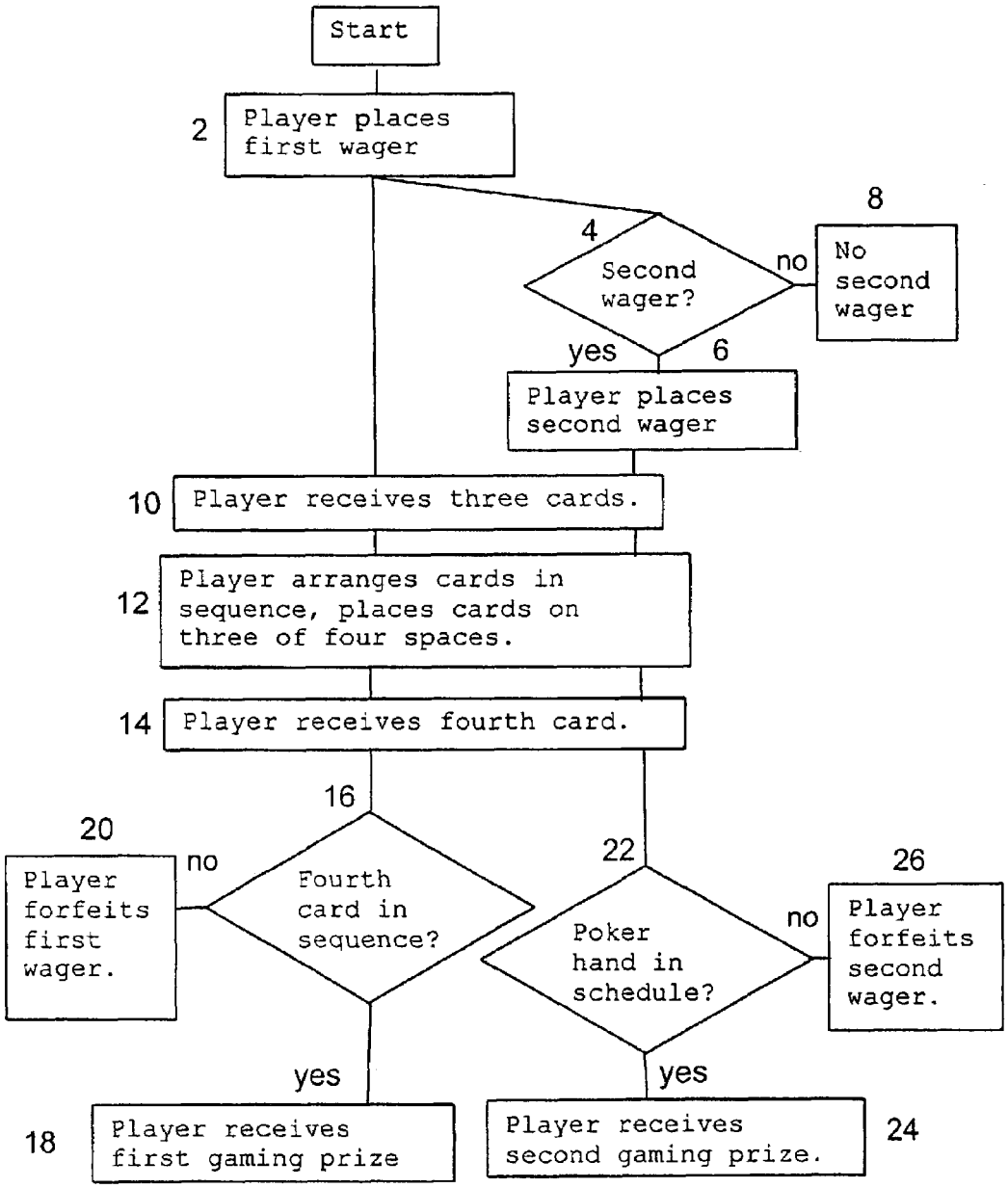
FIG. 1 is a flow chart of the Invention.

As shown by the flow chart of FIG. 1, to play the game of the Invention, a player places a first wager 2, also referred to herein as an 'in-between' wager. The player also may elect 4 whether or not to place a second wager, also referred to herein as a 'bonus bet.' If the player elects to place the second wager, the player makes the second wager 6. If the player elects not to make the second wager 8, the game proceeds on the in-between wager 2 alone.

The player receives three cards 10 from a conventional fifty-two card deck from a dealer. The dealer may use multiple decks. Each deck of playing cards includes cards of four suits (clubs, spades, hearts and diamonds). Each suit has cards with a face value of two through ten plus a jack, queen, king and ace. The cards in the deck thus form a sequence with the two, or deuce, being the lowest face value in the sequence and the ace being the highest face value. Each deck includes four cards of each face value; namely, one card of each suit.

The player arranges the cards 12 in sequential order by face value from lowest to highest. The player predicts where in the sequence of three cards that the face value of a future fourth card will fall. The player places the cards 12 physically on a playing table bearing indicia adapted for the purpose. The player leaves an empty space on the playing table corresponding to the player's prediction of where in the sequence a future fourth playing card will fall.

The player then receives a fourth card 14 from the dealer. The fourth card is placed on the space of the gaming table left empty by the player consistent with the player's prediction of where in the sequence the face value of the fourth card would fall. If the fourth card has a face value that falls within the sequence 16 as predicted by the player, then the player wins the first, or in-between, wager and receives a first gaming prize 18. If the face value of the fourth card does not fall within the sequence as predicted by the player, the player loses the first wager and forfeits the amount of the wager 20 to the gaming establishment. If the face values of any two or more of the four cards dealt to the player are equal (that is, if the player receives a pair, two pair, three-of-a-kind or four-of-a-kind), the player loses the in-between wager and forfeits the amount of that wager 20.

If the four cards received by the player form a poker hand as listed in a predetermined schedule of poker hands 22, the player wins the second, or 'bonus bet' wager and receives a second gaming prize 24 as specified by the schedule. The bonus bet wager 6 is independent of the in-between wager 2. If the four cards received by the player do not match a poker hand as specified in the schedule of poker hands 22, the player loses the 'bonus bet' wager and forfeits that amount of that wager 26 to the gaming establishment.

The amounts of the first gaming prize and the second gaming prize are set by the gaming establishment to provide adequate incentives for a player to continue to play while providing an adequate return to the gaming establishment.

Figure 2:
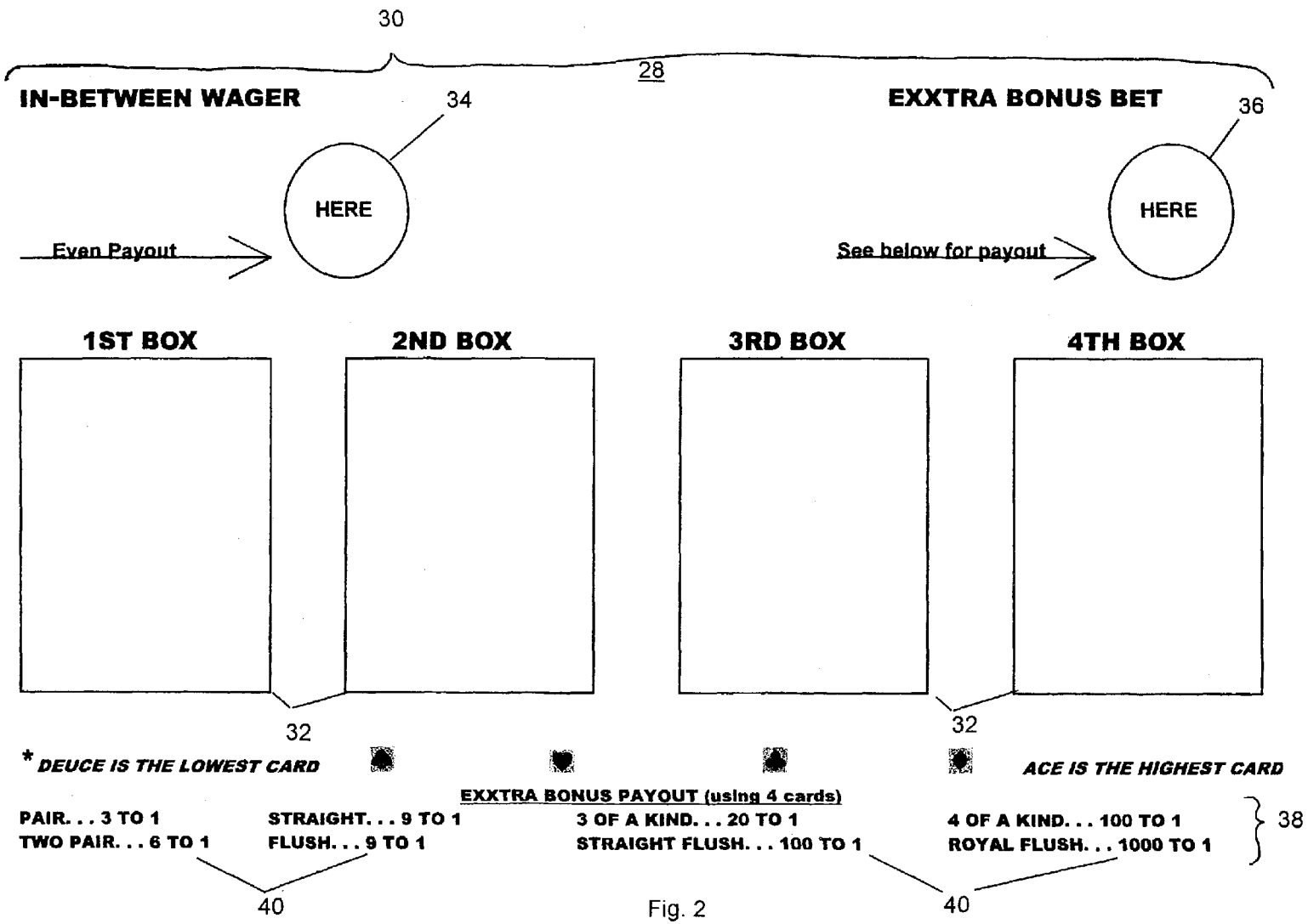
FIG. 2 is table top bearing indicia.

FIG. 2 illustrates a table 28 bearing indicia 30 to assist in the play of the present Invention in a gaming establishment. The indicia 30 may comprise printing, appliqués electronic displays or other conventional means to display information.

The indicia 30 include four boxes 32, numbered one through four. The four boxes also are referred to herein as "card locations." The table 28 bears first wager indicia 34 indicating a location for placing betting chips, tokens or cash as a first wager, or 'in-between wager.' The player may determine how much money the player chooses to bet on the first wager.

The table 28 also bears second wager indicia 36 indicating a location for placing betting chips, tokens or cash as a second wager, or 'bonus bet.' The player may elect to place a bonus bet, and, if so, the amount of the bonus bet. The player will win the bonus bet if the four cards received by the player in combination comprise a poker hand contained in a schedule 38 of poker hands. The table 28 may bear second wager payout indicia 40 indicating the payout amount for the schedule 38 of poker hands.

Figure 3:
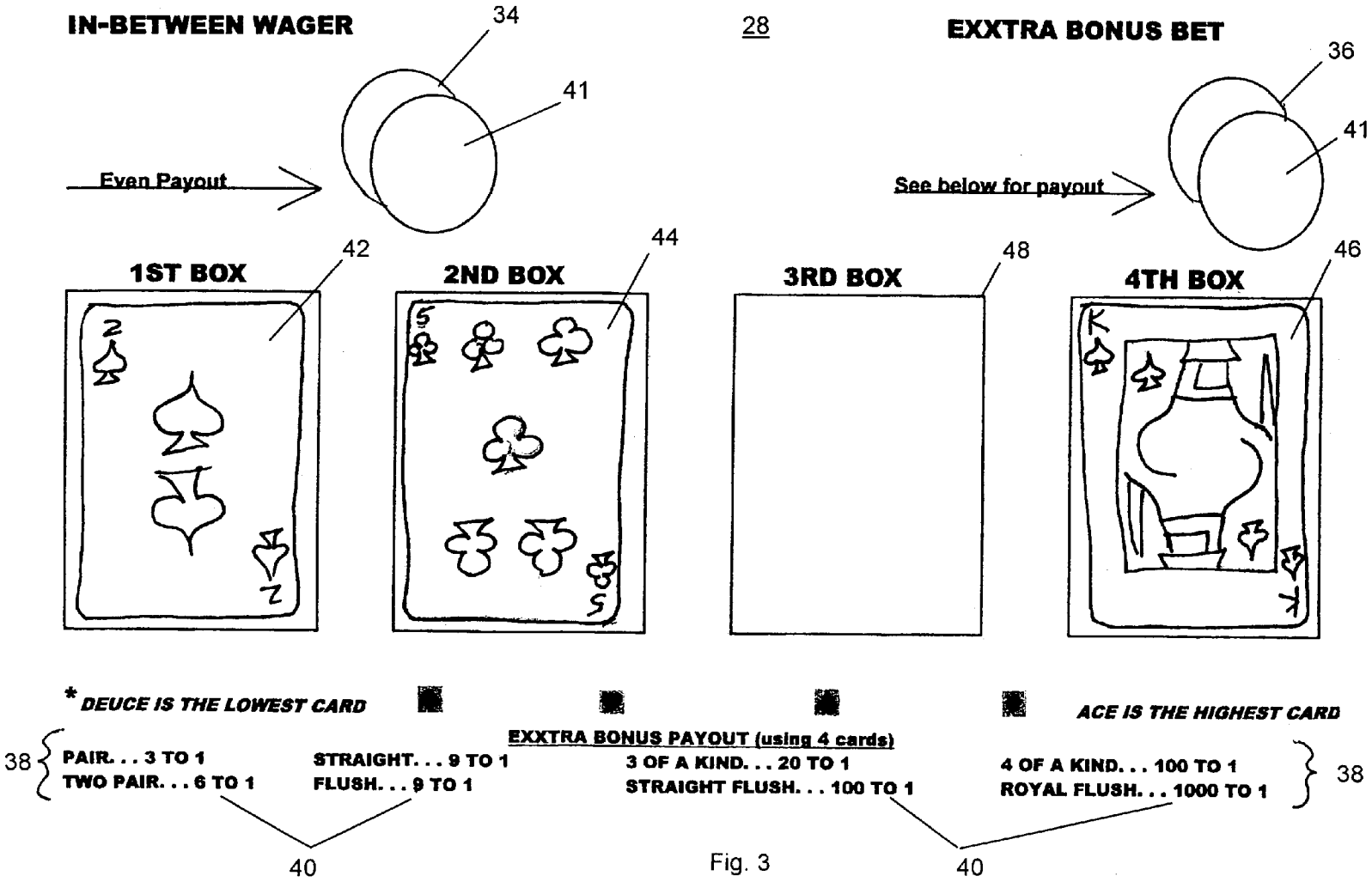
FIG. 3 is an example of the table top during game play, with the player receiving three cards.

The course of play of the Invention and use of the table 28 is illustrated by FIGS. 3-6. In FIG. 3, the player has placed a first, or in-between wager 2 and has placed a second, or bonus bet wager 6 by placing appropriate betting chips 41 representing cash on the first wager indicia 34 and the second wager indicia 36. In this example the player has been dealt three cards by a dealer 10. Those cards are the deuce of spades 42, a five of clubs 44 and a king of spades 46. The player has arranged the three cards in sequence and has made a prediction of where in the sequence the face value of a fourth card will fall. In this example, the player has predicted that the face value of the fourth card will fall between the five of clubs and the king of spades. Consistent with this prediction, the player has arranged the three cards 12 in the four boxes of the table top, leaving the box 48 between the five of clubs 44 and the king of spades 46 empty.

Figure 4:
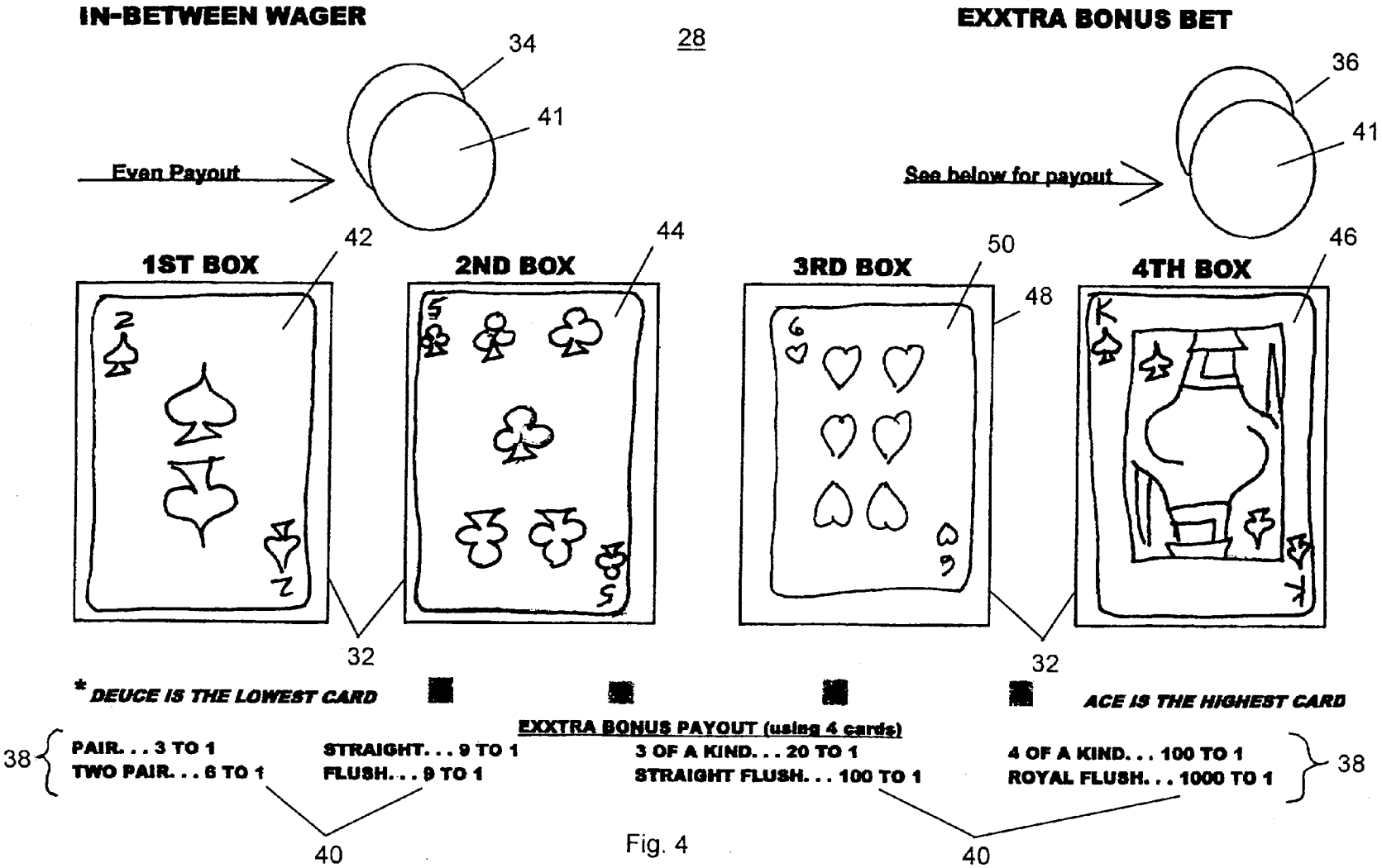
FIG. 4 is a first example of the player receiving a fourth card.

FIG. 4 presents a continuation of the example of FIG. 3. The player now has been dealt a fourth card 50, the six of hearts. The fourth card 50 is placed on the empty box 48 left by the player. In this case, the player's prediction is correct and the fourth card 50 is in sequence 16. The card 44 in the second box is higher in face value than the card 42 in the first box. Likewise, the card 50 in the third box is higher than the card 44 in the second box and the card 46 in the fourth box is higher in face value than the card 50 in the third box.

Because of the player's correct prediction shown in the example of FIG. 4, the player collects a first gaming prize 18. As shown by the payout specified in FIG. 4, the player will receive the amount of his or her wager 2 in an even payout; in other words, if the player wagered $1.00, the player will receive $1.00 as a first gaming prize 18. Although an even payout is specified by FIGS. 3-6 for the first gaming prize 18, the amount of the payout may be established by the gaming establishment at any amount that provides a sufficient incentive to the players and a sufficient return for the gaming establishment.

The poker hand 22 received by the player in the example of FIG. 4 does not appear on the schedule 38 of poker hands for the second, or 'bonus bet' wager 6. The player therefore does not win the bonus bet and forfeits his or her second, or 'bonus bet' wager 26.

Figure 5:
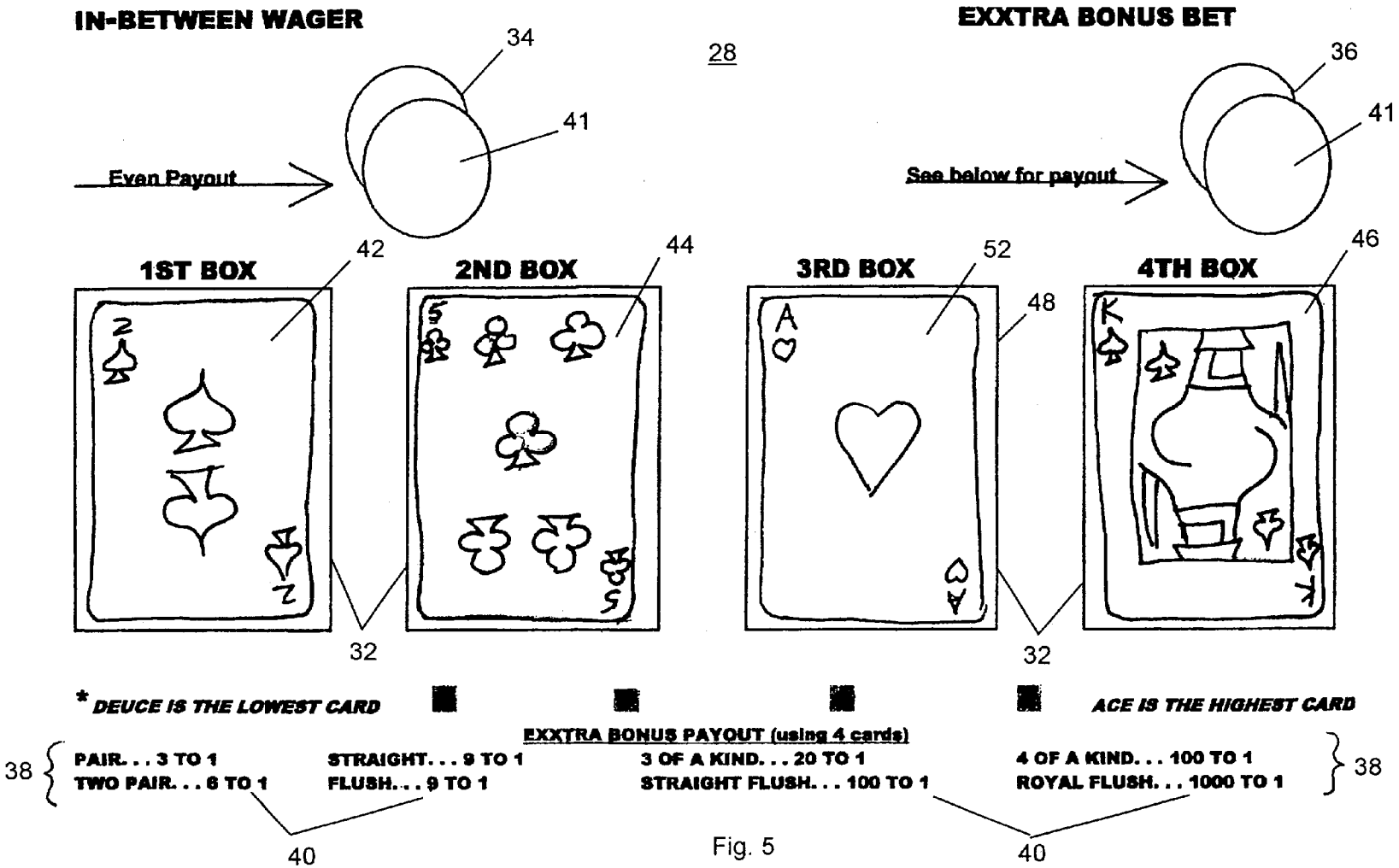
FIG. 5 is a second example of the player receiving a fourth card

FIG. 5 shows a second example of game play as an alternative to FIG. 4. In the example of FIG. 5, the fourth card 52 received by the player is an ace of hearts. The face value of the ace of hearts does not fall within the sequence 16 as predicted by the player because the face value of the card 46 in the fourth box is not greater than the face value of the card 52 in the third box. As a result, the player loses the in-between wager 2 and forfeits the first wager amount 20.

In addition, the poker hand 22 formed by the four cards 42,44,46,52 shown by FIG. 5 does not appear on the schedule 38 of poker hands for the bonus bet 6. As a result, the player loses the bonus bet 6 and forfeits the amount of player's second wager 26.

Figure 6:
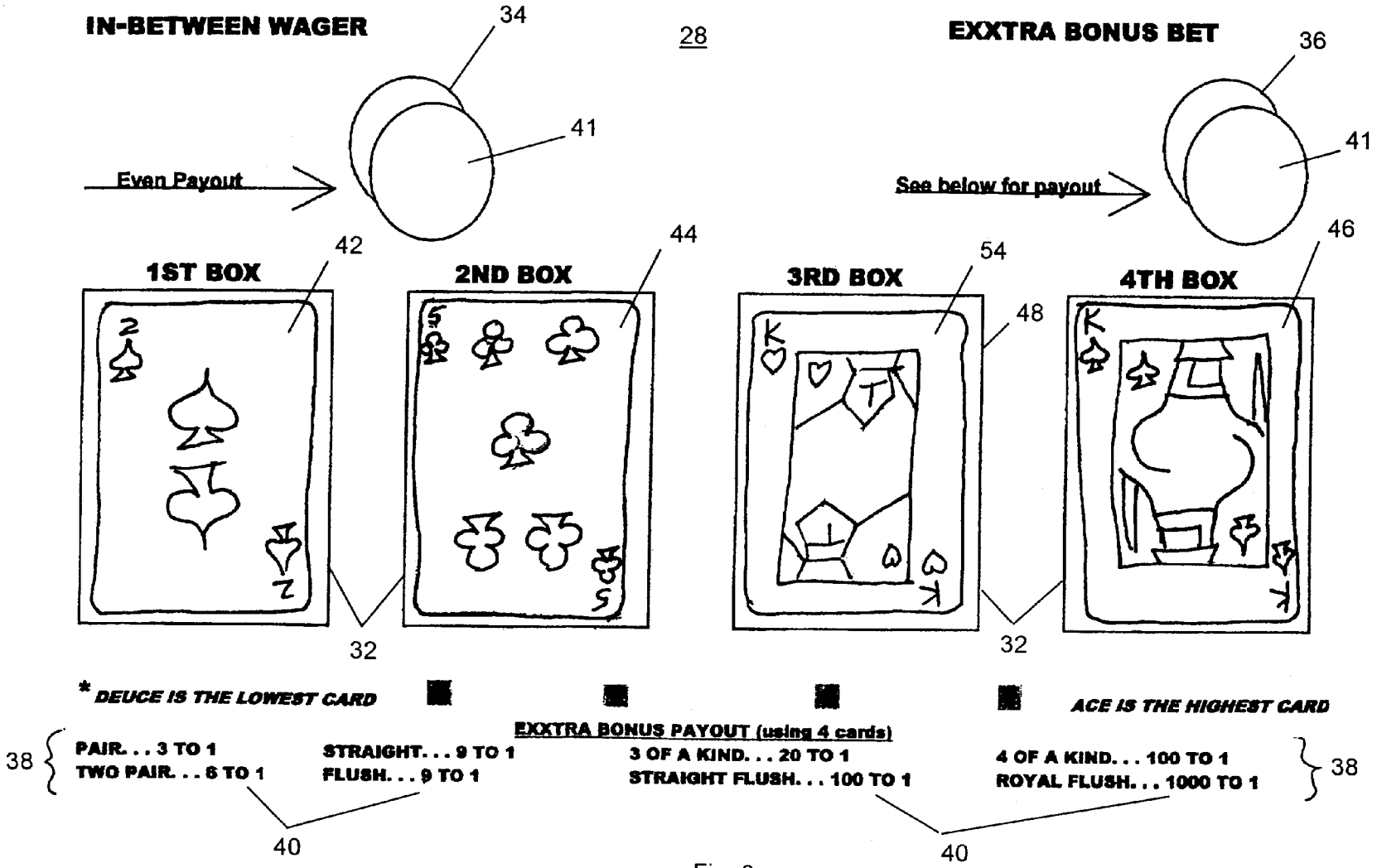
FIG. 6 is a third example of the player receiving a fourth card.

FIG. 6 shows a third example of game play. In FIG. 6, the fourth card dealt to player is a king of hearts 54. The player loses the in-between wager 2 because the player has received a pair and the card 46 in the fourth box is not higher in face value than the card 54 in the third box 48. Nonetheless, the player wins the bonus bet 6 because the poker hand 22 dealt to the player is a pair, which appears on the bonus bet payout schedule 38. The player receives the payout amount 40 specified in the bonus bet payout schedule. The amount 40 of the bonus bet payout is set by the gaming establishment to provide the player with an sufficient incentive to play the game while providing a sufficient return to the gaming establishment.

Figure 7:
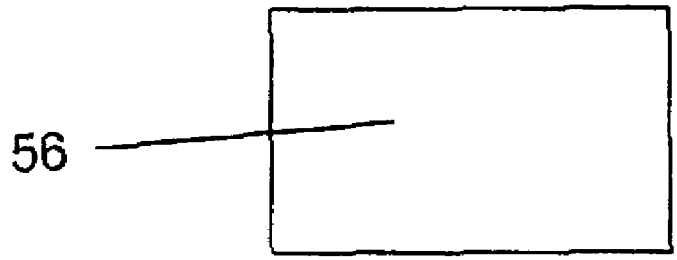
FIG. 7 is a stand-alone computer embodiment of the Invention.
Figure 8:
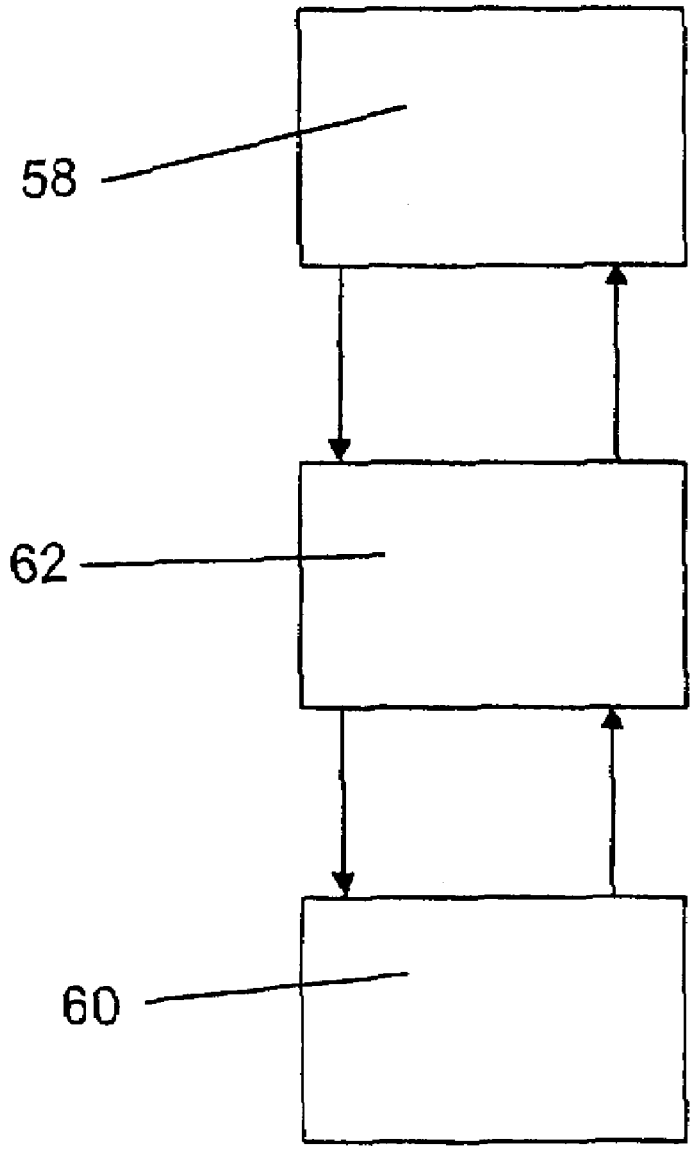
FIG. 8 is a computer network embodiment of the invention.

The playing surface may be displayed to the player on a table 28 using physical playing cards, as shown by FIGS. 2-6; conversely, the playing surface may be displayed to a player by a stand-alone computer 56, as shown by FIG. 7, or a client computer 58 attached to a server computer 60 through a network 62, as shown by FIG. 8. For purposes of this application, a stand-alone computer 56 is one or more computers programmed to perform the functions of the game, to receive commands from the player, and to display game play to the player. For purposes of this application, a client computer 58 is a computer programmed to receive information from a player and to display game play to a player, the client computer 58 communicating with a server computer 60 through a network 63 such as a local area network or an Internet and at least some of the game functions being performed by the server computer 60. A server computer 60 is a computer programmed to communicate with a client computer 58 over a network 62 and to perform at least some of the game functions.

The game may be played using values that appear in any sequential series, such as, for example, the set of cards in the familiar fifty-two card deck, the set of Arabic numerals between 1 and 100, or the set of letters of the alphabet. As used in this application, the term "value" refers to a member of any set exhibiting the characteristic of a sequential series. Where a set of values other than a fifty-two card deck is used, the in-between wager will proceed as described above. The gaming establishment may establish a schedule of bonus bets based upon subsets of the set of values, such subsets and the payouts for both the first and second wagers being selected such that the player is provided sufficient incentive to play and the gaming establishment is provided a sufficient return.

Many different embodiments of the above invention are possible. This application is intended to address all possible embodiments and is limited only as described in the following claims.

I claim:

1. A method of playing a game comprising the following sequential steps:

a. receiving by a player of a first value, a second value and a third value, said first, second and third values being selected in a substantially random manner, said first, second and third values each being selected from among a plurality of values, each of said plurality of values having a hierarchical relationship one with another, each of said first, second, and third values appearing to said player as an indicium on a substrate;

b. arranging by the player of said first, second and third values in a sequence corresponding to said hierarchical relationship;

c. predicting by the player of where within said sequence described by said first, second and third values that a fourth value will fall;

d. receiving by the player of a fourth value, said fourth value being selected in a substantially random manner, said fourth value being selected from among said plurality of values, said fourth value appearing as another said indicium on said substrate;

e. determining whether said prediction by said player was accurate.

2. The method of claim 1 further comprising the initial step of: placing of a first wager by the player as to whether the player will successfully predict where in said sequence said fourth value will fall.

3. The method of claim 2 further comprising the step of:

receiving by the player of a first prize if said prediction was correct and forfeiting said first wager amount if said prediction was incorrect.

4. The method of claim 2 further comprising:

a. placing of a second wager by said player;

b. determining whether said player will receive a second gaming prize based on predetermined criteria.

5. The method of claim 4 wherein the step of determining whether said player will receive said second gaming prize based on predetermined criteria comprises the further steps of:

a. comparing a poker hand formed by said first, second, third and fourth values to a schedule of said poker hands;

b. paying an amount of said second prize to said player as determined by said schedule of poker hands if said poker hand formed by said first, second, third and fourth values appear on said schedule of poker hands.

6. The method of claim 1 wherein:

a. said first value, said second value and said third value comprising face values of playing cards;

b. said substantially random selection of said first value, second value and third value resulting from a shuffling of one or more decks of said playing cards.

7. The method of claim 6, wherein said sequence comprises a hierarchy of face values of said playing cards.

* * * * *